US009113523B2

(12) United States Patent
Hsu et al.

(10) Patent No.: US 9,113,523 B2
(45) Date of Patent: Aug. 18, 2015

(54) LIGHT-EMITTING DIODE LIGHTING DEVICE HAVING MULTIPLE DRIVING STAGES

(71) Applicant: IML International, Grand Cayman (KY)

(72) Inventors: Horng-Bin Hsu, Taipei (TW); Yi-Mei Li, New Taipei (TW); Yung-Hsin Chiang, New Taipei (TW)

(73) Assignee: IML International, Grand Cayman (KY)

( * ) Notice: Subject to any disclaimer, the term of this patent is extended or adjusted under 35 U.S.C. 154(b) by 245 days.

(21) Appl. No.: 13/972,854

(22) Filed: Aug. 21, 2013

(65) Prior Publication Data

US 2014/0339990 A1 Nov. 20, 2014

Related U.S. Application Data

(60) Provisional application No. 61/823,409, filed on May 15, 2013.

(51) Int. Cl.
*H05B 33/08* (2006.01)

(52) U.S. Cl.
CPC ..... *H05B 33/083* (2013.01)

(58) Field of Classification Search
USPC ..... 315/160–176, 291–311
See application file for complete search history.

(56) References Cited

U.S. PATENT DOCUMENTS

| | | | | |
|---|---|---|---|---|
| 7,345,662 | B2 * | 3/2008 | Iwami | 345/82 |
| 2009/0167200 | A1 * | 7/2009 | Brokaw et al. | 315/224 |
| 2011/0260645 | A1 * | 10/2011 | Chen et al. | 315/294 |
| 2013/0278160 | A1 * | 10/2013 | Wu | 315/200 R |
| 2015/0015164 | A1 * | 1/2015 | Hsu et al. | 315/294 |

FOREIGN PATENT DOCUMENTS

| | | | |
|---|---|---|---|
| CN | 103139982 | | 6/2013 |
| JP | 2008277496 | A | 11/2008 |
| KR | 1020110022983 | A | 3/2011 |
| KR | 1020120082468 | A | 7/2012 |

* cited by examiner

*Primary Examiner* — Brandon S Cole
(74) *Attorney, Agent, or Firm* — Winston Hsu; Scott Margo

(57) ABSTRACT

An LED lighting device includes multiple driving stages. A first driving stage includes a first luminescent device driven by a first current and a first current controller coupled in parallel with the first luminescent device. The first current controller is configured to conduct a second current according to a voltage established across the first current controller and regulate the second current so that a sum of the first current and the second current does not exceed a first value. The second driving stage includes a second luminescent device driven by a third current and a second current controller coupled in series to the second luminescent device. The second current controller is configured to conduct a fourth current according to a voltage established across the second current controller and regulate the fourth current so that a sum of the third current and the fourth current does not exceed a second value.

15 Claims, 6 Drawing Sheets

LIGHT-EMITTING DIODE LIGHTING DEVICE HAVING MULTIPLE DRIVING STAGES

CROSS REFERENCE TO RELATED APPLICATIONS

This application claims the benefit of U.S. provisional application No. 61/823,409 filed on May 15, 2013.

BACKGROUND OF THE INVENTION

1. Field of the Invention

The present invention is related to an LED lighting device having multiple driving stages, and more particularly, to an LED lighting device having multiple driving stages for providing wide operational voltage range and high reliability.

2. Description of the Prior Art

Compared to traditional incandescent bulbs, light-emitting diodes (LEDs) are advantageous in low power consumption, long lifetime, small size, no warm-up time, fast reaction speed, and the ability to be manufactured as small or array devices. In addition to outdoor displays, traffic signs, and liquid crystal display (LCD) backlight for various electronic devices such as mobile phones, notebook computers or personal digital assistants (PDAs), LEDs are also widely used as indoor/outdoor lighting devices in place of fluorescent of incandescent lamps.

An LED lighting device directly driven by a rectified alternative-current (AC) voltage usually adopts a plurality of LEDs coupled in series in order to provide required luminance. As the number of the LEDs increases, a higher forward-bias voltage is required for turning on the LED lighting device, thereby reducing the effective operational voltage range of the LED lighting device. As the number of the LEDs decreases, the large driving current when the rectified voltage is at its maximum level may impact the reliability of the LEDs. Therefore, there is a need for an LED lighting device capable of improving the effective operational voltage range and the reliability.

SUMMARY OF THE INVENTION

The present invention provides an LED lighting device having a first driving stage and a second driving stage. The first driving stage includes a first luminescent device for providing light according to a first current; and a first current controller coupled in parallel with the first luminescent device and configured to conduct a second current according to a voltage established across the first current controller and regulate the second current so that a sum of the first current and the second current does not exceed a first value. The second driving stage includes a second luminescent device coupled in series to the first luminescent device for providing light according to a third current; and a second current controller coupled in series to the second luminescent device and configured to regulate the third current so that the third current does not exceed a second current setting which is larger than the first value, wherein each of the first and second luminescent devices includes one LED or multiple LEDs.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
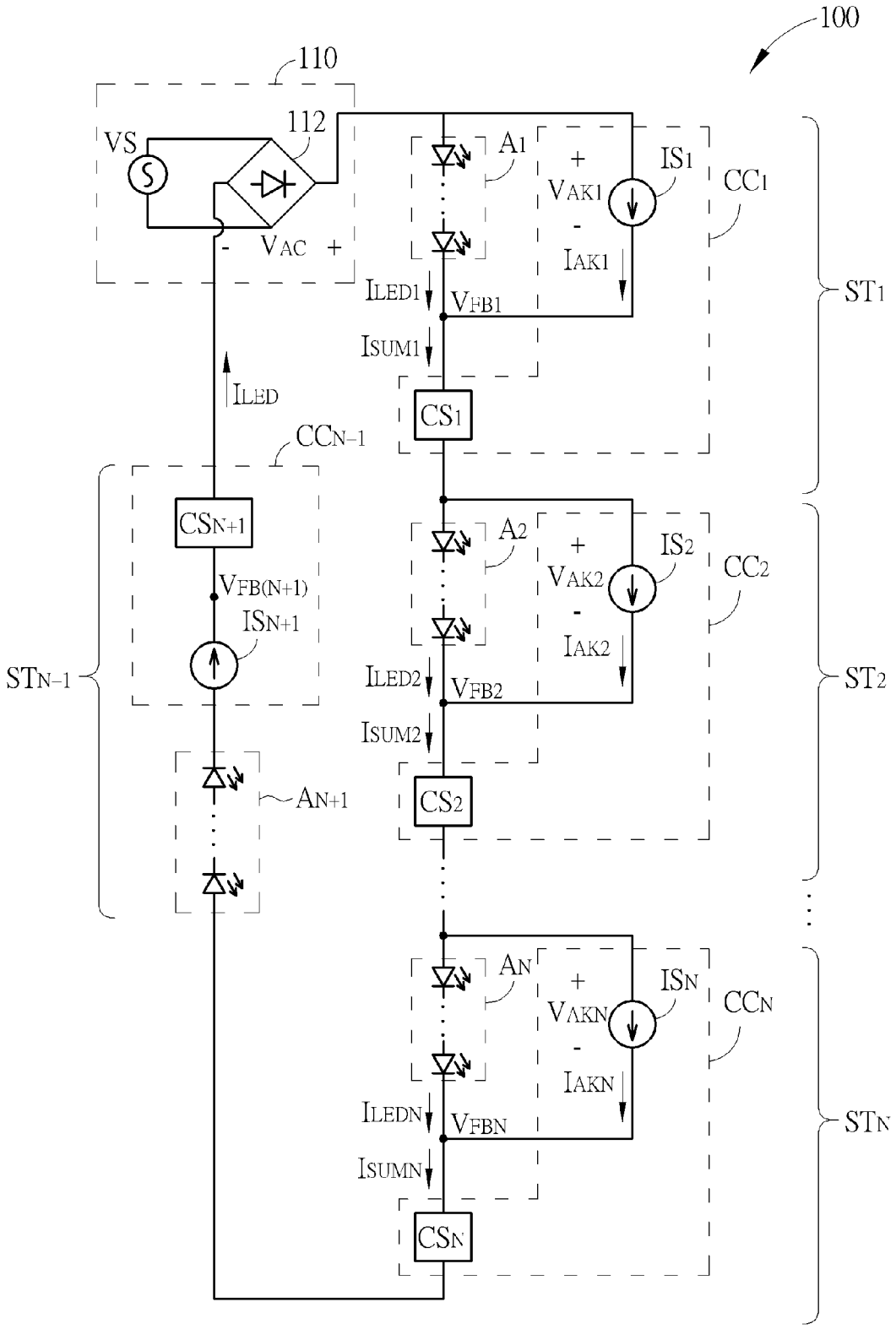
FIG. 1 is a diagram of an LED lighting device according to an embodiment of the present invention.

FIG. 1 is a diagram of an LED lighting device 100 according to an embodiment of the present invention. The LED lighting device 100 includes a power supply circuit 110 and (N+1) driving stages $ST_1$~$ST_{N+1}$ (N is a positive integer larger than 1). The power supply circuit 110 is configured to receive an AC voltage VS having positive and negative periods and convert the output of the AC voltage VS in the negative period using a bridge rectifier 112, thereby providing a rectified AC voltage $V_{AC}$, whose value varies periodically with time, for driving the (N+1) driving stages. In another embodiment, the power supply circuit 110 may receive any AC voltage VS, perform voltage conversion using an AC-AC converter, and rectify the converted AC voltage VS using the bridge rectifier 112, thereby providing the rectified AC voltage $V_{AC}$ whose value varies periodically with time. The configuration of the power supply circuit 110 does not limit the scope of the present invention.

Each driving stage includes a luminescent device and a current controller. Each current controller includes an adjustable current source and a current sensor. $A_1$~$A_{N+1}$ represent the luminescent devices in the corresponding driving stages $ST_1$~$ST_{N+1}$, respectively. $CC_1$~$CC_{N+1}$ represent the current controllers in the corresponding driving stages $ST_1$~$ST_{N+1}$, respectively. $IS_1$~$IS_{N+1}$ represent the adjustable current sources in the corresponding current controllers $CC_1$~$CC_{N+1}$, respectively. $CS_1$~$CS_{N+1}$ represent the current sensors in the corresponding current controllers $CC_1$~$CC_{N+1}$, respectively. $V_{AK1}$~$V_{AK(N+1)}$ represent the voltages established across the adjustable current sources $IS_1$~$IS_{N+1}$, respectively. $I_{AK1}$~$I_{AKN}$ represent the currents flowing through the adjustable current sources $IS_1$~$IS_N$, respectively. $I_{LED1}$~$I_{LEDN}$ represent the currents flowing through the luminescent devices $A_1$~$A_N$, respectively. $I_{SUM1}$~$I_{SUMN}$ represent the currents flowing through the corresponding driving stages $ST_1$~$ST_N$, respectively. $I_{LED}$ represents the current flowing through the driving stage $ST_{N+1}$, which is also the overall current flowing through the LED lighting device 100.

In the $1^{st}$ to $N^{th}$ driving stages $ST_1$~$ST_N$, the current sensors $CS_1$~$CS_N$ are configured to provide feedback voltages $V_{FB1}$~$V_{FBN}$ which are associated with the total currents $I_{SUM1}$~$I_{SUMN}$ flowing through the corresponding driving stages $ST_1$~$ST_N$, respectively. The adjustable current sources $IS_1$~$IS_N$, coupled in parallel with the corresponding luminescent devices $A_1$~$A_N$, are configured to regulate the currents $I_{AK1}$~$I_{AKN}$ according to the corresponding feedback voltages $V_{FB1}$~$V_{FBN}$, respectively. In other words, the maximum current settings $I_{SET1}$~$I_{SETN}$ of the $1^{st}$ to $N^{th}$ driving stages $ST_1$~$ST_N$ are determined by the corresponding adjustable current sources $IS_1$~$IS_N$ and the corresponding current sensors $CS_1$~$CS_N$, respectively.

In the $(N+1)^{th}$ driving stage $ST_{N+1}$, the current sensor $CS_{N+1}$, coupled in series to the corresponding luminescent device $A_{N+1}$ is configured to provide a feedback voltage $V_{FB(N+1)}$ which is associated with the total current $I_{LED}$ flowing through the $(N+1)^{th}$ driving stage $ST_{N+1}$. The adjustable current source $IS_{N+1}$, coupled in series to the corresponding luminescent device $A_{N+1}$ is configured to regulate the current $I_{LED}$ according to the feedback voltage $V_{FB(N+1)}$. In other words, the maximum current setting $I_{SET(N+1)}$ of the $(N+1)^{th}$ driving stage, which is also the maximum current setting of the LED lighting device 100, is determined by the adjustable current source $IS_{N+1}$ and the current sensor $CS_{N+1}$.

In the embodiment of the present invention, each of the luminescent devices $A_1$~$A_{N+1}$ may adopt a single LED or multiple LEDs coupled in series. FIG. 1 depicts the embodiment using multiple LEDs which may consist of single-junction LEDs, multi-junction high-voltage (HV) LEDs, or any combination of various types of LEDs. The types and configurations of the luminescent devices $A_1$~$A_{N+1}$ do not limit the scope of the present invention. In a specific driving stage, the dropout voltage $V_{DROP}$ for turning on the corresponding current controller is smaller than the cut-in voltage $V_{CUT}$ for turning on the corresponding luminescent device. The value of the cut-in voltage $V_{CUT}$ is related to the number or type of the LEDs in the corresponding luminescent device and may vary in different applications.

Figure 2:
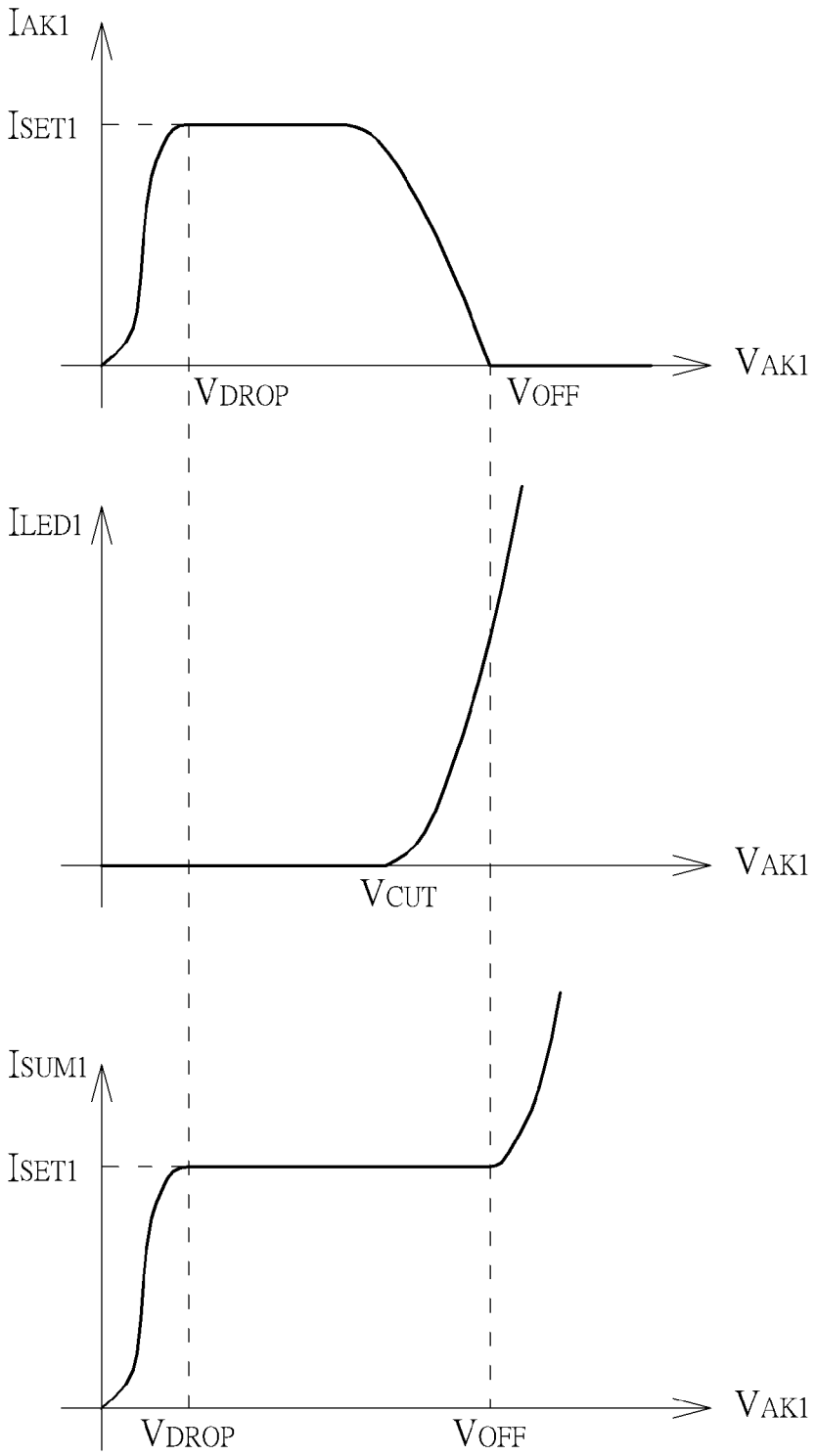
FIGS. 2 and 3 are diagrams illustrating the operation of the current controllers in the multiple driving stages.

FIG. 2 is a diagram illustrating the operation of the current controller in the driving stages $ST_1$~$ST_N$. The $1^{st}$ driving stage $ST_1$ is used for illustrative purpose. When $0<V_{AK1}<V_{DROP}$, the current controller $CC_1$ is not completely turned on, and the luminescent device $A_1$ remains off. Under such circumstance, the current controller $CC_1$ operates as a voltage-controlled device in a linear mode in which the current $I_{AK1}$ and the total current $I_{SUM1}$ change with the voltage $V_{AK1}$ in a specific manner, while the current $I_{LED1}$ remains zero.

When $V_{AK1}>V_{DROP}$, the current $I_{SUM1}$ reaches the maximum current setting $I_{SET1}$ of the $1^{st}$ driving stage $ST_1$, and the current controller $CC_1$ switches to a constant-current mode and functions as a current limiter. The current detector $CS_1$ is configured to monitor the value of the current $I_{SUM1}$ whose variation is reflected by the feedback voltage $V_{FB1}$. For example, when $V_{DROP}<V_{AK1}<V_{CUT}$, the luminescent device $A_1$ remains off and the current controller $CC_1$ is configured to clamp the current $I_{AK1}$ flowing through the current source $IS_1$ to the constant value $I_{SET1}$. When $V_{AK1}>V_{CUT}$, the luminescent device $A_1$ is turned on and the current $I_{LED1}$ starts to increase. Therefore, the current controller $CC_1$ may decrease the current $I_{AK1}$ flowing through the current source $IS_1$ according to the feedback voltage $V_{FB1}$, so that the total current $I_{SUM1}$ flowing through the $1^{st}$ driving stage may be maintained at the constant value $I_{SET1}$ instead of changing with the voltage $V_{AK1}$.

When the voltage $V_{AK1}$ reaches a turn-off voltage $V_{OFF}$, the current $I_{AK1}$ drops to zero and the current controller $CC_1$ switches to a cut-off mode. In other words, the current controller $CC_1$ functions as an open-circuited device, allowing the current $I_{LED1}$ and the current $I_{SUM1}$ to increase with the voltage $V_{AK1}$.

Figure 3:
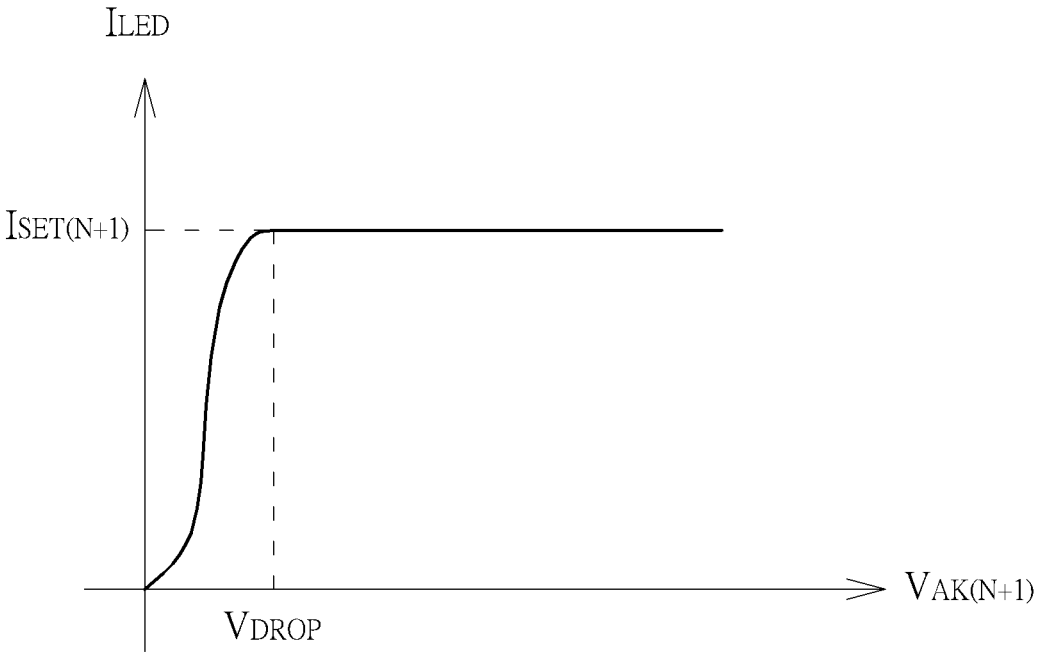

FIG. 3 is a diagram illustrating the operation of the $(N+1)^{th}$ driving stages $ST_{N+1}$. When $0<V_{AK(N+1)}<V_{DROP}$, the current controller $CC_{N+1}$ is not completely turned on. Under such circumstance, the current controller $CC_{N+1}$ operates as a voltage-controlled device in the linear mode in which the current $I_{LED}$ changes with the voltage $V_{AK(N+1)}$ in a specific manner. When $V_{AK(N+1)}>V_{DROP}$, the current $I_{LED}$ reaches the maximum current setting $I_{SET(N+1)}$ of the $(N+1)^{th}$ driving stages $ST_{N+1}$, and the current controller $CC_{N+1}$ switches to the constant-current mode and functions as a current limiter. The current detector $CS_{N+1}$ is configured to monitor the value of the current $I_{LED}$ whose variation may be reflected by the feedback voltage $V_{FB(N+1)}$. Therefore, the current controller $CC_{N+1}$ may switch back to the linear mode once the current $I_{LED}$ drops below $I_{SET(N+1)}$.

Figure 4:
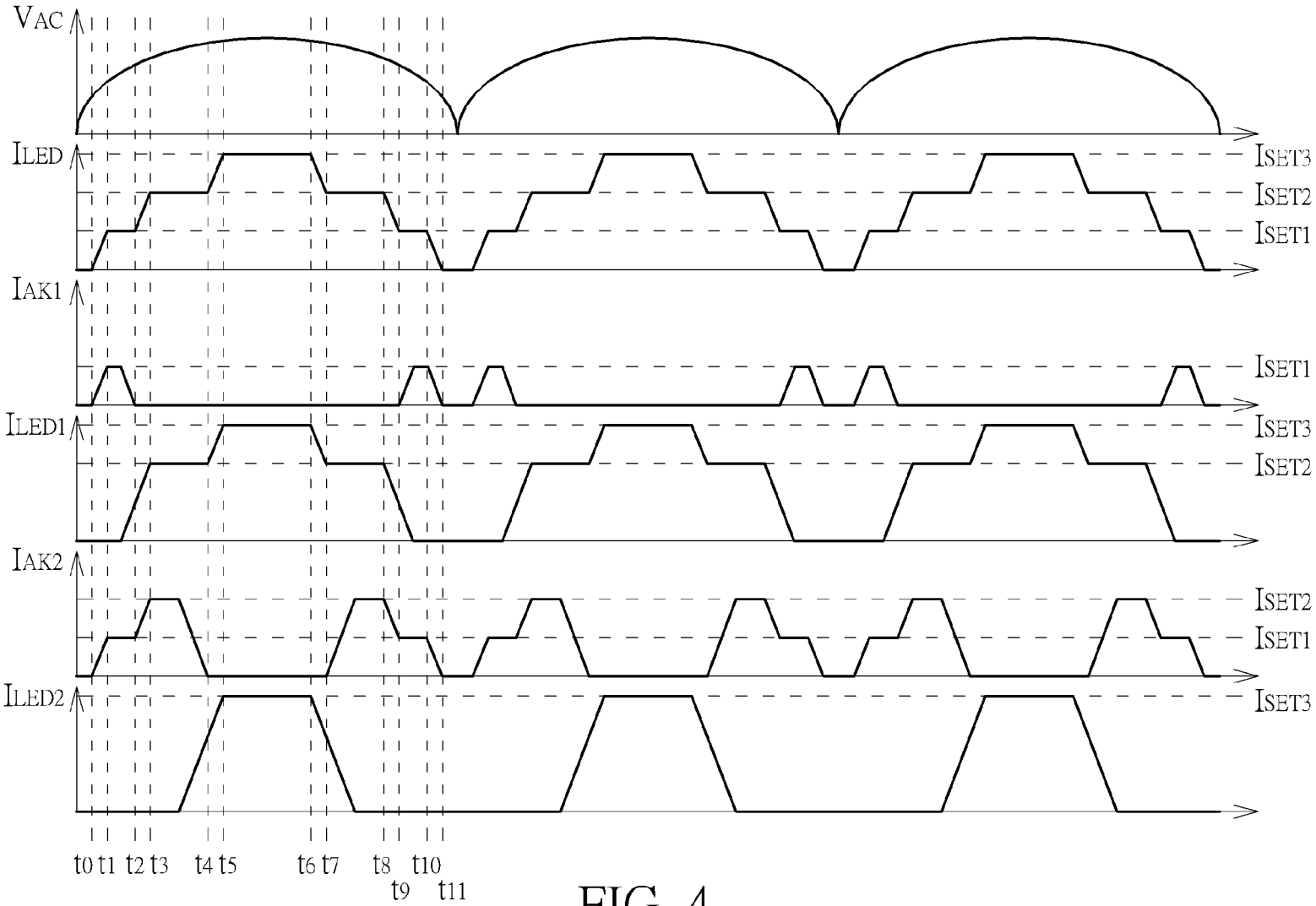
FIG. 4 is a diagram illustrating the operation of the LED lighting device.

FIG. 4 is a diagram illustrating the operation of the LED lighting device 100. The embodiment when N=2 is used for illustrative purpose. Since the voltages $V_{AK1}$~$V_{AK3}$ are associated with the rectified AC voltage $V_{AC}$ whose value varies periodically with time, a cycle of $t_0$-$t_{11}$ is used for illustration, wherein the period between $t_0$-$t_5$ belongs to the rising period of the rectified AC voltage $V_{AC}$ and the period between $t_6$-$t_{11}$ belongs to the falling period of the rectified AC voltage $V_{AC}$.

Before $t_0$, the rectified AC voltage $V_{AC}$ is small and the voltages $V_{AK1}$~$V_{AK3}$ are insufficient to turn on the luminescent devices $A_1$~$A_3$ or the current controllers $CC_1$~$CC_3$. Therefore, all the current controllers $CC_1$~$CC_3$ in the 3 driving stages ST1~ST3 operate in the cut-off mode, and the overall current $I_{LED}$ of the LED lighting device 100 is zero.

As previously stated, the turn-on voltages of the current controllers $CC_1$~$CC_3$ are smaller than those of the corresponding luminescent devices $A_1$~$A_3$ in the present invention. At $t_0$, the rectified AC voltage $V_{AC}$ becomes large enough so that the voltage $V_{AK1}$~$V_{AK3}$ are sufficient to turn on the current controllers $CC_1$~$CC_3$ and the luminescent device A3, but still insufficient to turn on the luminescent devices $A_1$~$A_2$, thereby allowing the current $I_{LED}$ to flow through the current controllers $CC_1$~$CC_3$ and the luminescent device $A_3$. Between $t_0$~$t_1$, all 3 current controllers $CC_1$~$CC_3$ operate in the linear mode in which the overall current $I_{LED}$ of the LED lighting device 100 increases with the rectified AC voltage $V_{AC}$ in a specific manner.

At $t_1$ as the current $I_{LED}$ reaches $I_{SET1}$, the current controller $CC_1$ in the first driving stage $ST_1$ switches to the constant-current mode, while the current controllers $CC_2$~$CC_3$ in the second and third driving stages $ST_2$~$ST_3$ remain operating in the linear mode. Between $t_1$~$t_2$ after the rectified AC voltage $V_{AC}$ becomes large enough so that the voltage $V_{AK1}$ is sufficient to turn on the luminescent device $A_1$, the current $I_{LED1}$ starts to increase with the rectified AC voltage $V_{AC}$. In response to the increase in the current $I_{LED1}$ which is monitored by current detector $CS_1$, the current controller $CC_1$ operating in the constant-current mode may decrease the current $I_{AK1}$ accordingly so that the overall current $I_{LED}$ of the LED lighting device 100 is maintained at a constant value ($I_{LED}=I_{SET1}$) regardless of the level of the rectified AC voltage $V_{AC}$.

At $t_2$ as the current $I_{AK1}$ drops to zero, the current controller $CC_1$ in the first driving stage $ST_1$ switches to the cut-off mode, while the current controllers $CC_2$~$CC_3$ in the second and third driving stages $ST_2$~$ST_3$ remain operating in the linear mode. Between $t_2$~$t_3$, the current $I_{LED}$ flows through the luminescent devices $A_1$ and $A_3$ and the current controllers $CC_2$~$CC_3$, and increases with the rectified AC voltage $V_{AC}$.

At $t_3$ as the current $I_{LED}$ reaches $I_{SET2}$, the current controller $CC_2$ in the second driving stage $ST_2$ switches to the constant-current mode, while the current controller $CC_1$ in the first driving stage $ST_1$ remains operating in the cut-off mode and the current controller $CC_3$ in the third driving stage $ST_3$ remains operating in the linear mode. Between $t_3$~$t_4$ after the rectified AC voltage $V_{AC}$ becomes large enough so that the voltage $V_{AK2}$ is sufficient to turn on the luminescent device $A_2$, the current $I_{LED2}$ starts to increase with the rectified AC voltage $V_{AC}$. In response to the increase in the current $I_{LED2}$ which is monitored by current detector $CS_2$, the current controller $CC_2$ operating in the constant-current mode may decrease the current $I_{AK2}$ accordingly so that the overall current $I_{LED}$ of the LED lighting device 100 is maintained at a constant value ($I_{LED}=I_{SET2}$) regardless of the level of the rectified AC voltage $V_{AC}$.

At $t_4$ as the current $I_{AK2}$ drops to zero, the current controller $CC_2$ in the second driving stage $ST_2$ switches to the cut-off mode, while the current controller $CC_1$ in the first driving stage $ST_1$ remains operating in the cut-off mode and the current controller $CC_3$ in the third driving stage $ST_3$ remains operating in the linear mode. Between $t_4$~$t_5$, the current $I_{LED}$ flows through the luminescent devices $A_1$~$A_3$ and the current controller $CC_3$, and increases with the rectified AC voltage $V_{AC}$.

At $t_5$ as the current $I_{LED}$ reaches $I_{SET3}$, the current controller $CC_3$ in the third driving stage $ST_3$ switches to the constant-current mode, while the current controllers $CC_1$~$CC_2$ in the first and second driving stages $ST_1$~$ST_2$ remain operating in the cut-off mode. Between $t_5$~$t_6$, the current $I_{LED}$ is maintained at a constant value ($I_{LED}=I_{SET3}$) regardless of the level of the rectified AC voltage $V_{AC}$. At $t_6$ as the current $I_{LED}$ becomes smaller than $I_{SET3}$ the current controller $CC_3$ switches back to the linear mode, allowing the current $I_{LED}$ to decrease with the rectified AC voltage $V_{AC}$. The intervals $t_0$~$t_1$, $t_1$~$t_2$, $t_2$~$t_3$, $t_3$~$t_4$ and $t_4$~$t_5$ during the rising period correspond to the intervals $t_{10}$~$t_{11}$, $t_9$~$t_{10}$, $t_8$~$t_9$, $t_7$~$t_8$ and $t_6$~$t_7$ during the falling period, respectively. Therefore, the operation of the LED lighting device 100 during $t_6$-$t_{11}$ is similar to that during $t_0$~$t_5$, as detailed in previous paragraphs.

The following table summarizes the operational modes of the current controllers $CC_1$~$CC_3$, wherein mode 1 represents the linear mode, mode 2 represents the constant-current mode, and mode 3 represents the cut-off mode.

TABLE

| | t0~t1<br>t10~t11 | t1~t2<br>t9~t10 | t2~t3<br>t8~t9 | t3~t4<br>t7~t8 | t4~t5<br>t6~t7 | t5~t6 |
|---|---|---|---|---|---|---|
| current controller $CC_1$ | mode 1 | mode 2 | mode 3 | mode 3 | mode 3 | mode 3 |
| current controller $CC_2$ | mode 1 | mode 1 | mode 1 | mode 2 | mode 3 | mode 3 |
| current controller $CC_3$ | mode 1 | mode 1 | mode 1 | mode 1 | mode 1 | mode 2 |

Figure 5:
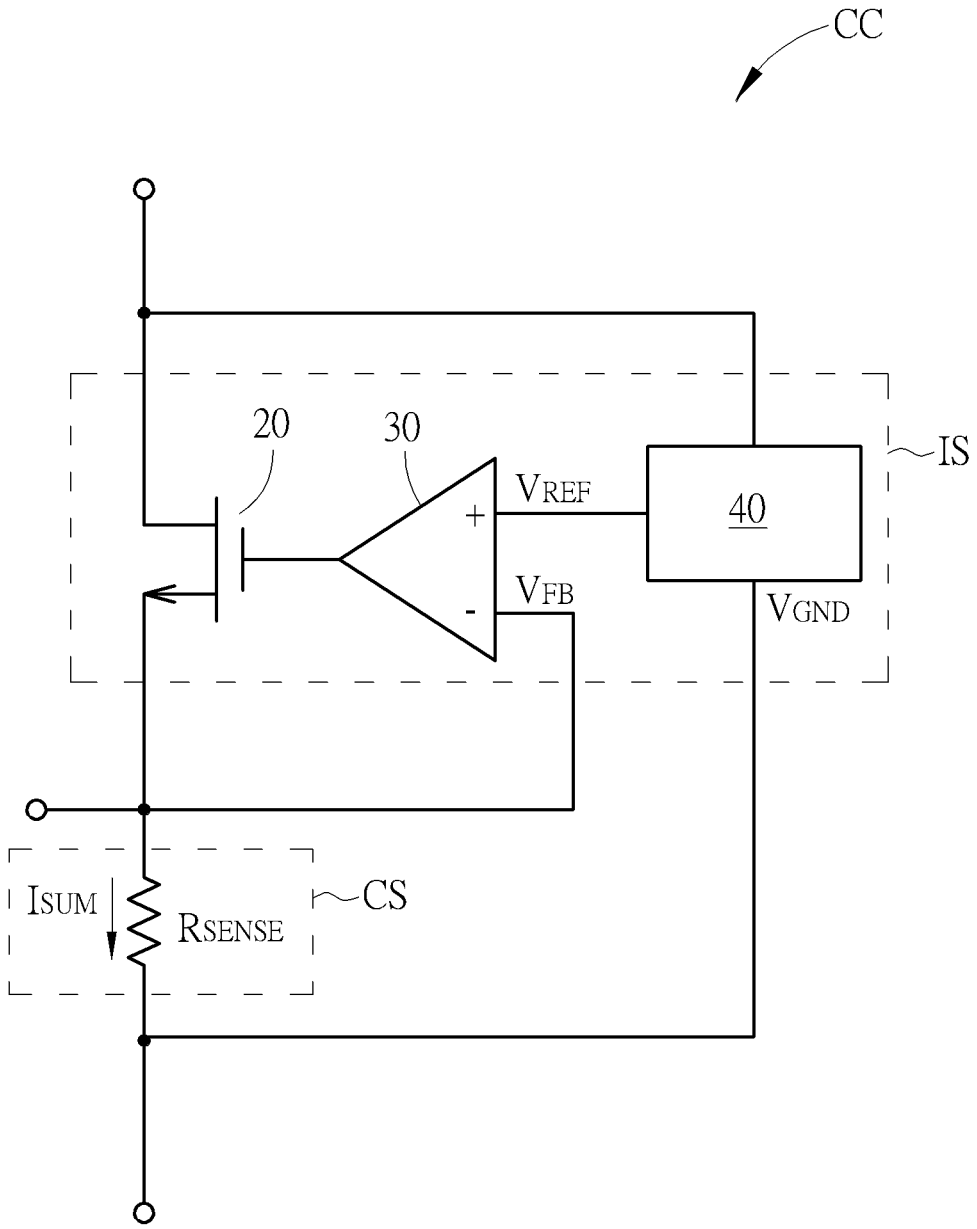
FIG. 5 is a diagram illustrating an embodiment of a current controller according to the present invention.

FIG. 5 is a diagram illustrating an embodiment of a current controllers CC according to the present invention. The current controller CC includes an adjustable current source IS and a current sensor CS. The current sensor CS includes a resistor $R_{SENSE}$ arranged to detect a current $I_{SUM}$ by providing a feedback voltage $V_{FB}$. The adjustable current source IS includes a transistor 20, an operational amplifier 30 and a voltage generator 40. The transistor 20 may include a field effect transistor (FET), a bipolar junction transistor (BJT) or other devices having similar function. In FIG. 5, an N-channel metal-oxide-semiconductor field effect transistor (N-MOSFET) is used for illustration, but does not limit the scope of the present invention. The voltage generator 40 is configured to provide a reference voltage $V_{REF}$ The operational amplifier 30 includes a positive input end coupled to the reference voltage $V_{REF}$, a negative input end coupled to the feedback voltage $V_{FB}$, and an output end coupled to the control end of the transistor 20. $V_{GND}$ represents a reference node in the current controllers CC.

The current setting $I_{SET}$ of the current controller CC is equal to ($V_{REF}/R_{SENSE}$). When $I_{SUM}<I_{SET}$, the operational amplifier 30 is configured to raise its output voltage for increasing the current flowing through the transistor 20 until the feedback voltage $V_{FB}$ reaches the reference voltage $V_{REF}$. When $I_{SUM}>I_{SET}$, the operational amplifier 30 is configured to decrease its output voltage for reducing the current flowing through the transistor 20 until the feedback voltage $V_{FB}$ reaches the reference voltage $V_{REF}$.

When applying the embodiment of FIG. 5 to the $1^{st}$ to $(N+1)^{th}$ driving stages $ST_1$~$ST_{N+1}$ illustrated in FIG. 1, the current controllers $CC_1$~$CC_{N+1}$ may operate according to specific reference voltages $V_{REF1}$~$V_{REF(N+1)}$ and the current sensors $CS_1$~$CS_{N+1}$ may adopt specific sensing resistors $R_{SENSE1}$~$R_{SENSE(N+1)}$ in order to provide different current settings $I_{SET1}$~$I_{SET(N+1)}$. For example, the current setting $I_{SET1}$ of the $1^{st}$ driving stage $ST_1$ may be equal to ($V_{REF1}/R_{SENSE1}$), the current setting $I_{SET2}$ of the $2^{nd}$ driving stage $ST_2$ may be equal to ($V_{REF2}/R_{SENSE2}$), . . . , and the current setting $I_{SET(N+1)}$ of the $(N+1)^{th}$ driving stage $ST_{N+1}$ may be equal to ($V_{REF(N+1)}/R_{SENSE(N+1)}$). The value of the current setting $I_{SET(N+1)}$ is larger than any of the current settings $I_{SET1}$~$I_{SETN}$.

In an embodiment of the present invention, the sensing resistors $R_{SENSE1}$~$R_{SENSE(N+1)}$ may be implemented as a programmable resistor array so that the turn-on/off sequence of the current controllers $CC_1$~$CC_{N+1}$ may be flexibly adjusted. In other words, the current setting $I_{SET(N+1)}$ is set to be the largest, and the current settings $I_{SET1}$~$I_{SETN}$ may have different relationships depending on the desired turn-on/off sequences. In the embodiment when N=2 as depicted in FIG. 4, the sensing resistors $R_{SENSE1}$~$R_{SENSE3}$ are chosen so that $I_{SET1}<I_{SET2}<I_{SET3}$ However, the relationship of the current settings $I_{SET1}$~$I_{SETN}$ do not limit the scope of the present invention.

Figure 6:
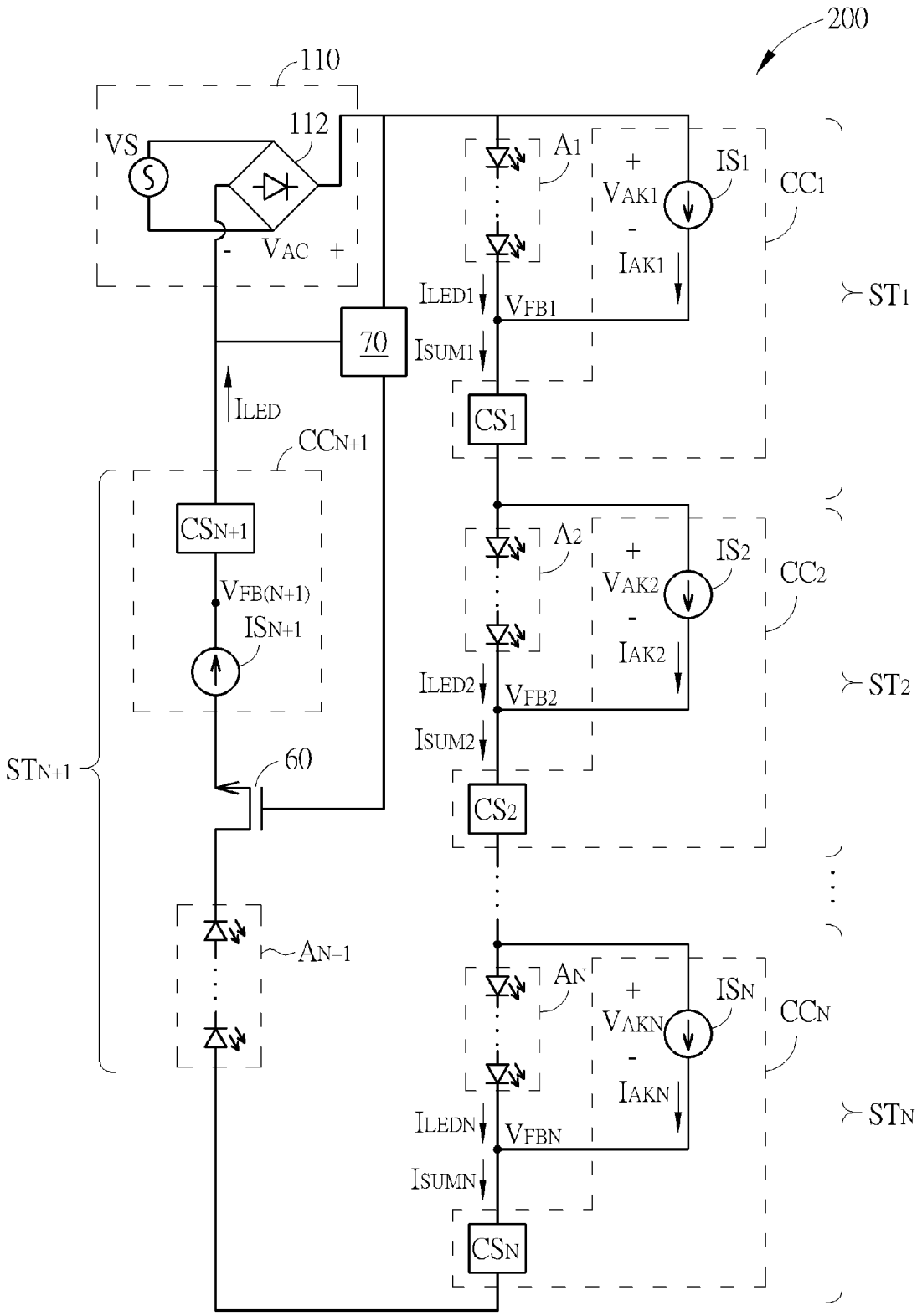
FIG. 6 is a diagram of an LED lighting device according to another embodiment of the present invention.

FIG. 6 is a diagram of an LED lighting device 200 according to another embodiment of the present invention. The LED lighting device 200 includes a power supply circuit 110 and (N+1) driving stages $ST_1$~$ST_{N+1}$ (N is a positive integer larger than 1). The configurations and operations of the $1^{st}$ to $N^{th}$ driving stages $ST_1$~$ST_N$ in the LED lighting device 200 are identical to those of the LED lighting device 100, as illustrated in previous paragraphs. The configuration and operation of the $(N+1)^{th}$ driving stage $ST_{N+1}$ in the LED lighting device 200 are similar to those of the LED lighting device 100, but the $(N+1)^{th}$ driving stage $ST_{N+1}$ in the LED lighting device 200 further includes a high-voltage transistor 60 and a voltage clamping circuit 70. The transistor 60 may include an FET, a BJT or other devices having similar function. In FIG. 6, an N-MOSFET is used for illustration, but does not limit the scope of the present invention. In a scenario when the AC voltage VS somehow fluctuates and the rectified AC voltage $V_{AC}$ is raised above its upper design limit, the voltage clamping circuit 70 is configured to clamp the voltage established across the current controllers $CC_{N+1}$ at a upper limit and allow the redundant voltage due to the fluctuations of the rectified AC voltage $V_{AC}$ to drop on the high-voltage transistor 60, thereby providing overvoltage protection to the luminescent devices $A_1$~$A_{N+1}$ and the current controllers $CC_1$~$CC_{N+1}$. In another scenario when the redundant voltage due to the fluctuations of the rectified AC voltage $V_{AC}$ exceeds the upper drain-to-source voltage limit of the high-voltage transistor 60, the voltage clamping circuit 70 may provide overvoltage protection to the luminescent devices $A_1$~$A_{N+1}$ and the current controllers $CC_1$~$CC_{N+1}$ by turning off the transistor 60.

With the above-mentioned multi-stage driving scheme, the present invention may turn on multiple luminescent devices flexibly using multiple current controllers. The LED lighting device of the present invention may adopt different amount and various types of luminescent devices since the overall LED current is regulated according to the current of each driving stage instead of the cut-in voltage of the LEDs.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light-emitting diode (LED) lighting device having multiple driving stages, comprising:

a first driving stage including:

a first luminescent device for providing light according to a first current; and a first current controller coupled in parallel with the first luminescent device and configured to conduct a second current according to a voltage established across the first current controller and regulate the second current so that a sum of the first current and the second current does not exceed a first value; and a second driving stage including:

a second luminescent device coupled in series to the first luminescent device for providing light according to a third current; and a second current controller coupled in series to the second luminescent device and configured to regulate the third current so that the third current does not exceed a second current setting which is larger than the first value, wherein each of the first and second luminescent devices includes one LED or multiple LEDs.

2. The LED lighting device of claim 1, wherein:

during a rising period of a rectified alternative-current (AC) voltage when the voltage established across the first current controller does not exceed a first voltage, the first current controller operates in a first mode in which the second current increases with the rectified AC voltage;

during the rising period when the voltage established across the first current controller exceeds the first voltage and the second current is larger than zero, the first current controller operates in a second mode in which the sum of the first current and the second current is maintained at the first value; and during the rising period when the voltage established across the first current controller exceeds the first voltage and the second current is equal to zero, the first current controller operates in a third mode in which the first current controller is turned off.

3. The LED lighting device of claim 2, wherein:

during the rising period when the voltage established across the first current controller exceeds the first voltage but is smaller than a turn-on voltage of the first luminescent device, the first current controller is configured to operates in the second mode by clamping the second current at the first value; and during the rising period when the voltage established across the first current controller exceeds the turn-on voltage of the first luminescent device, the first current controller is configured to operates in the second mode by reducing the second current as the first current increases so that the sum of the first current and the second current is maintained at the first value.

4. The LED lighting device of claim 2, wherein:

during a falling period of the rectified AC voltage when the voltage established across the first current controller does not exceed the first voltage, the first current controller operates in the first mode in which the second current decreases with the rectified AC voltage;

during the falling period when the voltage established across the first current controller exceeds the first voltage and the second current is larger than zero, the first current controller operates in the second mode in which the sum of the first current and the second current is maintained at the first value; and during the falling period when the voltage established across the first current controller exceeds the first voltage and the second current is equal to zero, the first current controller operates in the third mode in which the first current controller is turned off.

5. The LED lighting device of claim 4, wherein:

during the falling period when the voltage established across the first current controller exceeds the first voltage but is smaller than the turn-on voltage of the first luminescent device, the first current controller is configured to operates in the second mode by clamping the second current at the first value; and during the falling period when the voltage established across the first current controller exceeds the turn-on voltage of the first luminescent device, the first current controller is configured to operates in the second mode by increasing the second current as the first current decreases so that the sum of the first current and the second current is maintained at the first value.

6. The LED lighting device of claim 2, wherein the first current controller includes:

a first current sensor configured to provide a first feedback voltage which is associated with the sum of the first current and the second current;

a first adjustable current source configured to:

conduct the second current according to the rectified AC voltage when the first current controller operates in the first mode;

regulate the second current according to the first feedback voltage when the first current controller operates in the second mode; and switch off when the first current controller operates in the third mode.

7. The LED lighting device of claim 6, wherein:

the first adjustable current source includes:

a voltage generator configured to provide a reference voltage;

an operational amplifier configured to provide a control voltage according to a difference between the reference voltage and the first feedback voltage, the operational amplifier including:

a first input end coupled to the reference voltage;

a second input end coupled to the first feedback voltage; and an output end for outputting the control voltage;

a transistor configured to conduct the second current according to the control voltage, the transistor including:

a first end coupled to a first end of the first luminescent device;

a second end coupled to a second end of the first luminescent device; and a control end coupled to the output end of the operational amplifier; and the first current sensor includes a resistor having a first end coupled to the second end of the transistor and a second end coupled to a reference node.

8. The LED lighting device of claim 1, wherein:

during a rising period of a AC voltage when the voltage established across the second current controller does not exceed a second voltage, the second current controller operates in a first mode in which the third current increases with the rectified AC voltage; and during the rising period when the voltage established across the second current controller exceeds the second voltage, the second current controller operates in a second mode in which the third current is maintained at a second value.

9. The LED lighting device of claim 8, wherein:

during a falling period of the rectified AC voltage when the voltage established across the second current controller does not exceed the second voltage, the second current controller operates in the first mode in which the third current decreases with the rectified AC voltage; and during the falling period when the voltage established across the second current controller exceeds the second voltage, the second current controller operates in the second mode in which the third current is maintained at the second value.

10. The LED lighting device of claim 8, wherein the second current controller includes:

a second current sensor coupled in series to the second luminescent device and configured to provide a second feedback voltage which is associated with the third current; and a second adjustable current source configured to:

conduct the third current according to the rectified AC voltage when the second current controller operates in the first mode; and regulate the third current according to the second feedback voltage when the second current controller operates in the second mode.

11. The LED lighting device of claim 10, wherein:

the second adjustable current source includes:

a voltage generator configured to provide a reference voltage;

an operational amplifier configured to provide a control voltage according to a difference between the reference voltage and the second feedback voltage, the operational amplifier including:

a first input end coupled to the reference voltage;

a second input end coupled to the second feedback voltage; and an output end for outputting the control voltage;

a transistor configured to conduct the third current according to the control voltage, the transistor including:

a first end coupled to an end of the second luminescent device;

a second end; and a control end coupled to the output end of the operational amplifier; and the second current sensor includes a resistor having a first end coupled to the second end of the transistor and a second end coupled to a reference node.

12. The LED lighting device of claim 1, further comprising a third driving stage which includes:

a third luminescent device coupled in series to the first luminescent device and the second luminescent device for providing light according to a fourth current; and a third current controller coupled in parallel with the third luminescent device and configured to conduct a fifth current according to a voltage established across the third current controller and regulate the fifth current so that a sum of the fourth current and the fifth current does not exceed a third value.

13. The LED lighting device of claim 1 further comprising a power supply circuit configured to provide a rectified AC voltage for driving the first luminescent device and the second luminescent device.

14. The LED lighting device of claim 13 wherein the power supply circuit includes an AC-AC voltage converter.

15. The LED lighting device of claim 1 wherein the second driving stage further comprises:

a transistor including:

a first end coupled to the second luminescent device;

a second end coupled to the second current controller; and a control end; and a voltage clamping circuit coupled to the control end of the transistor and configured to control the transistor according to a rectified AC voltage for driving the first luminescent device and the second luminescent device.

* * * * *